United States Patent [19]

Suzuki

[11] Patent Number: 4,779,505

[45] Date of Patent: Oct. 25, 1988

[54] ELECTRONIC MUSICAL INSTRUMENT OF FULL-WAVE READOUT SYSTEM

[75] Inventor: Hideo Suzuki, Shizuoka, Japan

[73] Assignee: Nippon Gakki Seizo Kabushiki Kaisha, Hamamatsu, Japan

[21] Appl. No.: 88,510

[22] Filed: Aug. 20, 1987

Related U.S. Application Data

[63] Continuation of Ser. No. 859,618, May 5, 1986, abandoned, which is a continuation of Ser. No. 647,710, Sep. 5, 1984, abandoned.

[30] Foreign Application Priority Data

Sep. 7, 1983 [JP] Japan ..... 58-163336
Jul. 30, 1984 [JP] Japan ..... 59-157291

[51] Int. Cl.[4] ..... G10H 1/08; G10H 1/46; G10H 7/00

[52] U.S. Cl. ..... 84/1.22; 84/1.01; 84/1.1; 84/1.27

[58] Field of Search ..... 84/1.01, 1.09, 1.1, 84/1.19, 1.22, 1.26, 1.27, DIG. 9

[56] References Cited

U.S. PATENT DOCUMENTS

| | | | |
|---|---|---|---|
| 3,651,730 | 3/1972 | Adachi | 84/1.27 X |
| 3,819,844 | 6/1974 | Isii | 84/1.26 |
| 4,130,043 | 12/1978 | Niimi | 84/1.19 X |
| 4,138,915 | 2/1979 | Nagai et al. | 84/1.22 |
| 4,205,575 | 6/1980 | Hoskinson et al. | 84/1.01 |
| 4,205,577 | 6/1980 | Deutsch | 84/1.22 X |
| 4,227,435 | 10/1980 | Ando et al. | 84/1.22 X |
| 4,383,462 | 5/1983 | Nagai et al. | 84/1.26 |
| 4,437,379 | 3/1984 | Okumura | 84/1.22 |
| 4,444,082 | 4/1984 | Whitefield | 84/1.22 X |
| 4,510,836 | 4/1985 | Markowitz | 84/1.26 |
| 4,635,520 | 1/1987 | Mitsumi | 84/1.26 |
| 4,638,710 | 1/1987 | Kitamura et al. | 84/1.26 |
| 4,641,564 | 2/1987 | Okamoto | 84/1.22 |

FOREIGN PATENT DOCUMENTS 58-142396 8/1983 Japan .

*Primary Examiner*—Stanley J. Witkowski
*Attorney, Agent, or Firm*—Blakely, Sokoloff, Taylor & Zafman

[57] ABSTRACT

An electronic musical instrument includes a waveshape generator which generates first and second waveshapes having a pitch corresponding to a designated note. The first waveshape represents a complete waveshape produced by a certain musical instrument under a certain extreme condition (e.g., the hardest key touch). The second waveshape represents a complete waveshape produced by the same musical instrument under another extreme condition (e.g., the softest key touch). The electronic musical instrument further includes an interpolator which interpolates the first and second waveshapes in accordance with a playing condition (e.g., the strength of key touch) and produces and interpolated new waveshape as a waveshape of a musical tone to be produced. The introduction of this interpolator enables any waveshape under an intermediate condition to produce by preparing only two waveshapes under the two extreme conditions.

48 Claims, 9 Drawing Sheets

FIG.10A
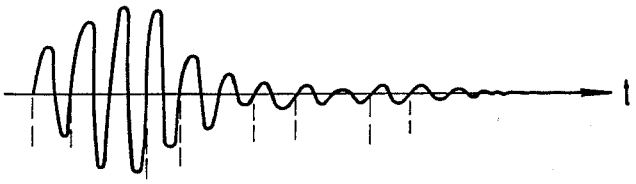
FIG.10B
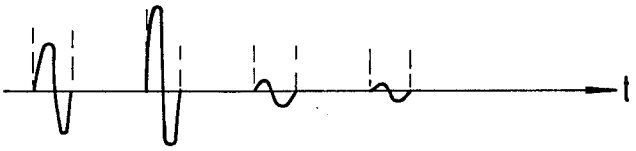
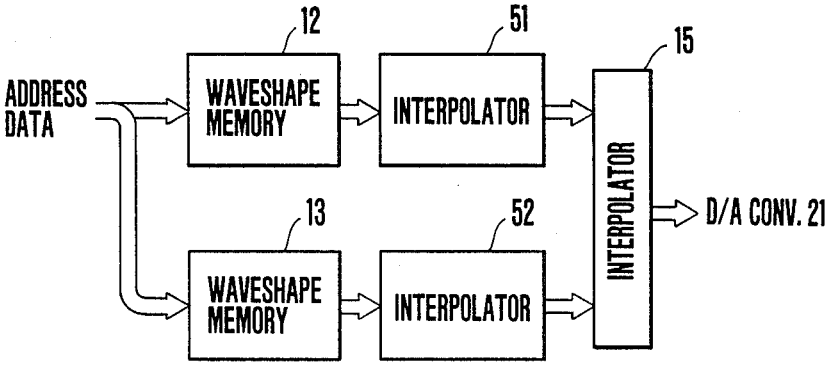
FIG.11

ELECTRONIC MUSICAL INSTRUMENT OF FULL-WAVE READOUT SYSTEM

This is a continuation of application Ser. No. 859,618 filed May 5, 1986, now abandoned which, application, is a continuation of application Ser. No. 647,710 filed Sept. 5, 1984, now abandoned.

BACKGROUND OF THE INVENTION

The present invention relates to an electronic musical instrument having waveshape memories for storing musical tone data representing the beginning to the end of musical tones so as to produce high-quality musical tones in accordance with the read out musical tone data.

Nowadays, electronic tone generation is performed such that data of a complete waveshape from the beginning to the end of an actual musical tone waveshape, or data of a leading portion and part of the subsequent portion of the musical tone waveshape are stored. When the complete waveshape data is stored, it is read out to produce a high-quality musical tone signal. However, when the data of the leading portion and part of the subsequent portion are stored, the data of the leading portion is read out, and then the part of the subsequent portion is repeatedly read out to produce a high-quality musical tone signal.

A typical example of a musical tone generation system of this type is described in U.S. Pat. No. 4,383,462. As shown in FIG. 3 of U.S. Pat. No. 4,383,462, a complete is stored in a waveshape memory WM 31, and the waveshape data is read out in response to a KD signal representing a key depression timing. In FIG. 6 of U.S. Pat. No. 4,383,462, three memories WM 61, WM 62 and WM 63 are used. A complete waveshape during an attack period is stored in the WM 61, a musical tone waveshape during at least one fundamental period is stored in the WM 62, and an envelope waveshape from the sustain to decay periods is stored in the WM 63. After the waveshape data is read out from the WM 61 in response to the key depression timing signal KD, the waveshape data are sequentially read out from the memories WM 62 and WM 63.

The system for prestoring the complete waveshape data for a number of periods can easily produce a high-quality musical tone signal. However, a large memory capacity is required. It is very difficult for conventional electronic musical instruments to assign different tone colors to each key touch or pitch. This is because all tone color parameters for each key touch or pitch must be stored in different waveshape memories in units of tone color parameters. As a result, the overall memory capacity becomes very large, resulting in an impractical system.

According to another conventional system, two different waveshapes are interpolated to synthesize a musical tone waveshape. This system is described in U.S. Pat. No. 4,437,379, and realizes key scaling by interpolation between the two different waveshapes. As shown in FIG. 1 of U.S. Pat. No. 4,437,379, a high tone-range waveshape memory 4, a low tone-range waveshape memory 5 and a reference tone range memory 3 store high tone-range waveshape data, low tone-range waveshape data and reference tone-range waveshape data, respectively. One of the high and low tone-range waveshapes is selected by a selector 7 by determining whether a tone-range of a depressed key is a higher or lower range than the reference tone range. For example, when a player depresses a key falling within the range between the high tone-range waveshape and the reference tone-range waveshape, the high and low tone-range waveshapes are interpolated to produce a tone waveshape corresponding to the difference between the depressed key belonging tone range and the reference tone range. However, according to U.S. Pat. No. 4,437,379, the high, low and reference tone-range waveshapes are the musical tone waveshapes for specific periods and are repeatedly read out until the musical tone decays. As a result, a musical tone of sufficiently high quality cannot be produced.

SUMMARY OF THE INVENTION

It is, therefore, a principal object of the present invention to provide an electronic musical instrument for producing high-quality musical tones with a variety of tone color changes in a small arrangement at low cost.

In order to achieve the above object of the present invention, there is provided an electronic musical instrument comprising: pitch designating means for designating a pitch of a musical tone to be produced; first waveshape generating means for generating first waveshape data constituting a complete waveshape corresponding to a beginning to an end of tone production; second waveshape generating means for generating second waveshape data constituting a complete waveshape corresponding to a beginning to an end of tone production; mixing information generating means for generating mixing information representing a mixing ratio of said first waveshape data to said second waveshape data; and interpolating means connected to said first and second waveshape generating means for mixing said first and second waveshape data at said mixing ratio and forming a musical tone waveshape for said musical tone to be produced; said first waveshape generating means comprising a first memory which stores first to Nth block waveshape data associated to first to Nth block waveshapes belonging to first to Nth blocks into which a first musical tone waveshape is divided, N being an integer greater than or equal to 2 and first readout means which reads out said first to Nth block waveshape data at a rate corresponding to the designated pitch as said first waveshape data; and said second waveshape generating means comprising a second memory which stores first to Mth block waveshape data associated to first to Mth block waveshapes belonging to first to Mth blocks into which a second musical tone waveshape is divided, M being an integer greater than or equal to 2 and second readout means which reads out said first to Mth block waveshape data at said rate as said second waveshape data. More particularly, different musical tone waveshapes corresponding to different key touches can be produced. For example, when different tone waveshapes corresponding to different key touches are synthesized, continuous waveshapes corresponding to the hardest touch and the softest touch are stored in waveshape memories and are simultaneously read out and interpolated, thereby obtaining a tone waveshape corresponding to a degree of touch.

Furthermore, according to the present invention, a means is proposed to lock the phases of the two tone waveshapes to be interpolated. When the phases of the waveshapes to be interpolated do not have substantially the same phase, beat noise occurs due to a phase shift. In addition to this disadvantage, the interpolation operation itself becomes useless. In general, any two actual musical tone waveshapes generated under different conditions do not have the same phase. Even if the beginning portions of these two waveshapes are phase-locked, the subsequent portions are usually subjected to phase shift. Therefore, when the actual musical tone waveshapes are interpolated, a phase-locking technique must be adopted to lock their phases. For this purpose, one waveshape is filtered through a filter which has an amplitude-frequency characteristic (f-characteristic) corresponding to a difference between the f-characteristics of the two waveshapes and which has a substantially linear phase. The filtered waveshape is then interpolated with the other waveshape.

According to this technique, the filtered waveshape has the same f-characteristic and phase as the other waveshape, so no problem occurs in interpolation. In addition, in order to make the other waveshape coincide with the actual musical tone waveshape, the two waveshapes are divided into a plurality of frames. In this case, the above operation is performed in units of frames.

BRIEF DESCRIPTION OF THE DRAWINGS

FIG. 10A shows an entire musical tone waveshape;

FIG. 10B shows blocks of the entire musical tone waveshape which are stored in waveshape memories; and FIG. 11 is a block diagram of a circuit for generating a continuous musical tone waveshape.

DESCRIPTION OF THE PREFERRED EMBODIMENTS

Figure 1:
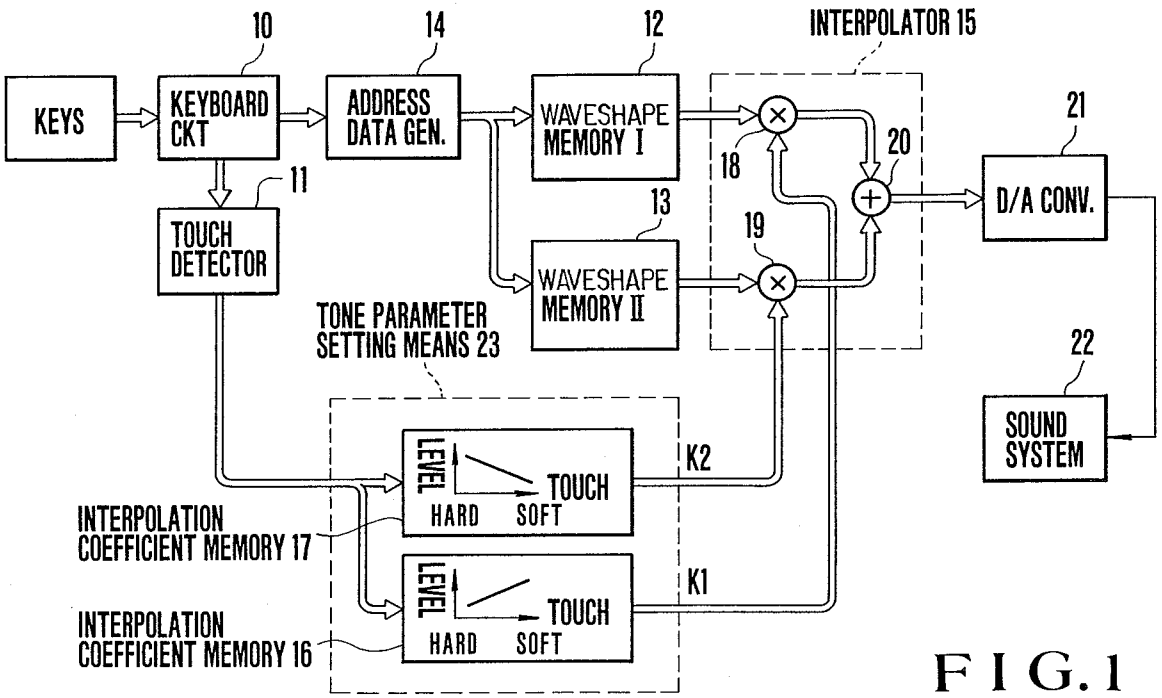
FIG. 1 is a block diagram of an electronic musical instrument according to an embodiment of the present invention.

FIG. 1 shows an electronic musical instrument according to an embodiment of the present invention. Referring to FIG. 1, a keyboard circuit 10 has a plurality of keys serving as pitch designating means. A touch of a depressed key at the keyboard circuit 10 is detected by a touch detector 11. Tones produced by a conventional keyboard musical instrument such as a piano have different magnitudes and tone colors in accordance with hard and soft touches. The detected touch data is used as a parameter for changing a tone color, and a tone waveshape signal having a tone color corresponding to the degree of the touch is produced in the same manner as the conventional keyboard musical instrument. A first waveshape memory 12 stores complete waveshape data representing a waveshape (to be referred to as a first waveshape) with specific tone characteristics from the beginning to the end of the musical tone. A second waveshape memory 13 stores another complete waveshape data representing a waveshape (to be referred to as a second waveshape) which is different from the first waveshape and which continues from the beginning to the end of the musical tone. In this embodiment, the first waveshape has softest key touch characteristics, and the second waveshape has hardest key touch characteristics.

An address data generator 14 arranged between the keyboard circuit 10 and the first and second memories 12 and 13 generates read address data for respectively reading out the complete waveshape data from the first and second waveshape memories 12 and 13 in accordance with a pitch rate specified at the keyboard circuit 10. The first and second waveshape signals are respectively read out from the first and second waveshape memories 12 and 13 in response to the address data generated from the address data generator 14. The first and second waveshape signals are supplied to a mixer or interpolator 15.

As described above, the touch of the depressed key at the keyboard circuit 10 is detected by the touch detector 11. The touch detection data corresponding to the degree of touch detected by the touch detector 11 is supplied to a tone color parameter setting means 23. The touch detector 11 may comprise a detector for detecting a depression speed, as described in U.S. Pat. No. 3,819,844 or a detector for detecting an acceleration (depression force) of the depressed key, as described in U.S. Pat. No. 3,651,730. These types of touch detector are known to those skilled in the art, and a detailed description thereof will be omitted. In the following description, an output from the touch detector 11 is simply referred to as touch data. However, if the touch detector 11 comprises a detector for detecting the depression speed, the first waveshape represents a minimum depression speed and the second waveshape represents a maximum depression speed. On the other hand, if the touch detector 11 comprises a detector for detecting an acceleration (depression force) of the depressed key, the first waveshape represents a minimum depression force and the second waveshape represents a maximum depression force.

The tone parameter setting means 23 has interpolation coefficient memories 16 and 17 for storing tone color parameters corresponding to various degrees of touch. Interpolation coefficients K1 and K2 correspond to the touch data detected by the touch detector 11 and are produced from the memories 16 and 17. The interpolation coefficients K1 and K2 serve as tone color parameters. More particularly, the interpolation coefficient memories 16 and 17 store the first and second interpolation coefficients K1 and K2 which represent inverse characteristics to each other with respect to the degree of touch. The first interpolation coefficient K1 has a larger value when the touch becomes softer. The level of the first waveshape signal (corresponding to the softest touch) read out from the first memory 12 is controlled by a multiplier 18 in the interpolator 15 in accordance with the first interpolation coefficient K1. The second interpolation coefficient K2 has a larger value when the touch becomes harder. The level of the second waveshape signal (corresponding to the hardest touch) read out from the second memory 13 is controlled by a multiplier 19 in the interpolator 15 in accordance with the second interpolation coefficient K2. Outputs from the multipliers 18 and 19 are added by an adder 20, so that an interpolated waveshape signal is generated from the interpolator 15. This waveshape ignal is converted by a D/A converter 21 to an analog signal. The analog signal is supplied to a sound system 22 and is produced as a musical tone thereat.

As previously described, when the two waveshapes to be interpolated are not in phase, interpolation itself becomes useless. Beat noise is generated due to a phase error. The first and second waveshapes stored in the first and second waveshape memories have different phases since they are produced by a conventional keyboard musical instrument. Even if the beginning portions of the first and second waveshapes are in phase, a phase error starts occurring in a few seconds. In order to solve this problem, the first and second waveshapes stored in the first and second waveshape memories 12 and 13 must be preprocessed in the following manner.

Processing 1

Figures 2A, 2B:
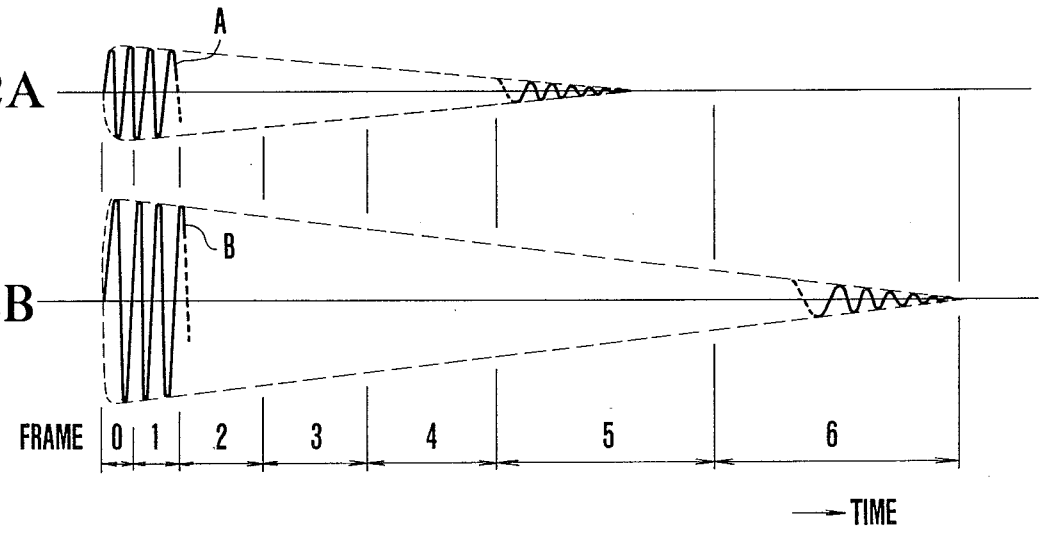
FIGS. 2A and 2B show two original waveshapes generated from an an identical conventional musical instrument under different conditions, respectively.

A predetermined conventional musical instrument (e.g., a piano) is played with the softest touch, and an original waveshape A for a plurality of periods from the beginning to the end of musical tone is obtained, as shown in FIG. 2A. The same musical instrument is then played with the hardest touch, and an original waveshape B is obtained in the same manner as described above, as shown in FIG. 2B. The original waveshapes A and B have the same pitch.

Processing 2

The original waveshapes A and B are processed to decrease a phase difference so as to establish a given relationship therebetween. This phase processing is performed as an example in Processing 2a to Processing 2c in such a manner that the original waveshape B is filtered through a filter having substantially linear phase characteristics to obtain a waveshape similar to the waveshape A.

Processing 2a

Figure 3A:
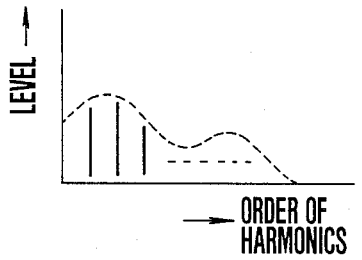
FIGS. 3A and 3B show waveshape spectra of the waveshapes during a specific interval of the waveshapes shown in FIGS. 2A and 2B, respectively.
Figure 3B:
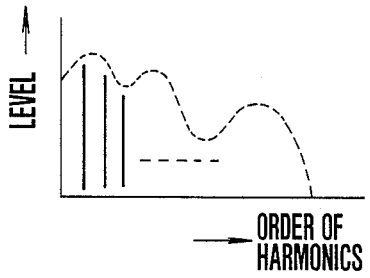

The entire waveshape intervals of the original waveshapes A and B are divided into a plurality of frames (time windows). The respective waveshapes are subjected to spectral analysis in units of frames. The frames need not be set at equal intervals but may vary in accordance with the features of waveshape changes. In this embodiment, seven frames 0 to 6 are used. The spectral analysis result of one-frame portion of the original waveshape A is illustrated in FIG. 3A, and that of the original waveshape B is illustrated in FIG. 3B.

Processing 2b

Figure 3C:
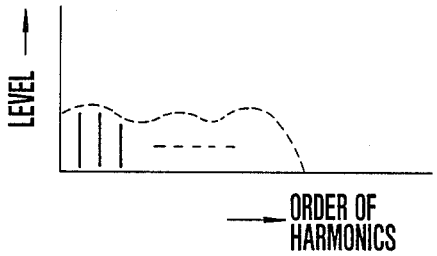
FIG. 3 shows a spectral difference between the spectra shown in FIGS. 3A and 3B.

Spectral differences between the spectra analyzed by Processing 2a are calculated in units of frames. The spectral difference of the spectra of FIGS. 3A and 3B is illustrated in FIG. 3C.

Processing 2c

The original waveshape B corresponding to the hardest touch is filtered by a filter which has an attenuation characteristic corresponding to the spectral differences of the respective frames and which has substantially linear phase characteristics. Therefore, the resultant waveshape corresponds to the softest touch, has substantially the same phase as the original waveshape B, and is similar to the original waveshape A.

After Processing 2c, the original waveshape B corresponding to the hardest touch is stored in the first waveshape memory 12. The filtered waveshape similar to the original waveshape A and corresponding to the softest touch is stored in the second waveshape memory 13. In this manner, the waveshape stored in the second waveshape memory 13 is similar to the original waveshape A but is obtained by filtering the original signal B. The filtered waveshape has substantially the same phase as the original waveshape B. It is thus readily understood that the waveshapes stored in the first and second waveshape memories 12 and 13 have the same phase.

Processing 2 may be replaced with Processing 2′ below.

Processing 2′

One of the original waveshapes A and B is phase-shifted by a proper time for every predetermined interval so as to lock the phases of the waveshapes A and B. The phase-corrected original waveshapes A and B are then stored in the second and first memories 13 and 12. The phases of the waveshapes to be stored in the waveshape memories 12 and 13 may coincide with each other.

In this manner, the first and second waveshape memories 12 and 13 respectively store the waveshapes which correspond to the hardest and the softest touches and which have substantially the same phase. Therefore, when the waveshapes from the waveshape memories 12 and 13 are interpolated by the interpolator 15, no problems occur and no beat noise is generated due to the phase error, thereby synthesizing a musical tone waveshape.

Figure 4:
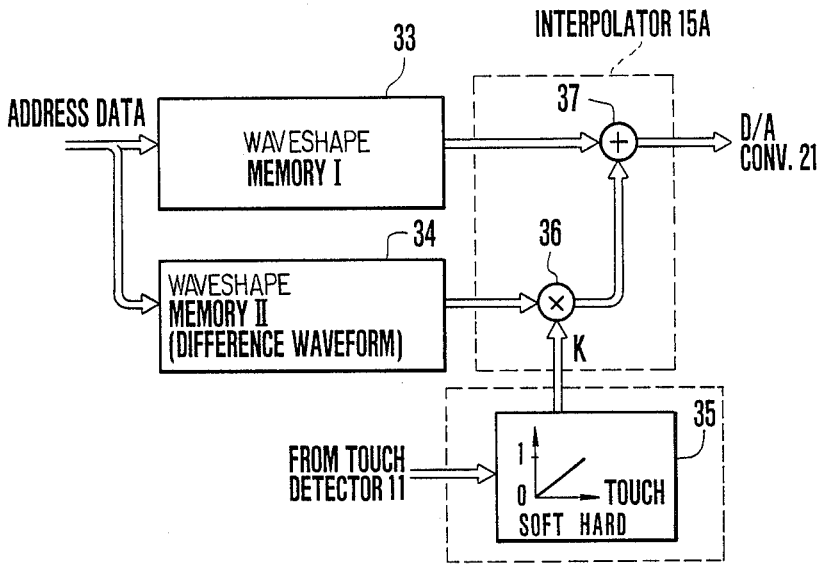
FIG. 4 is a block diagram showing the main part of an electronic musical instrument according to another embodiment of the present invention.

FIG. 4 shows another embodiment of the present invention, particularly showing components different from those in FIG. 1. A first waveshape memory 33 stores a phase-corrected waveshape which is obtained by Processing 2a to Processing 2c or Processing 2′ and which corresponds to the softest touch. In this embodiment, in addition to Processing 1 and Processing 2 (2a to 2c and 2′), Processing 3 is performed as follows.

Processing 3

A difference between a phase-corrected original waveshape obtained by Processing 2 and the other original waveshape is calculated in units of sampling points, thereby obtaining a phase-corrected difference waveshape. This difference waveshape is stored in a second waveshape memory 34. A tone color parameter setting means 23A has an interpolation coefficient memory 35 for generating an interpolation coefficient K corresponding to the touch data detected by the touch detector 11. An interpolator 15A comprises a multiplier 36 for multiplying the interpolation coefficient K with the difference waveshape data read out from the second waveshape memory 34, and an adder 37 for adding an output from the multiplier 36 and an output (corresponding to the softest touch) read out from the first waveshape memory 33. The coefficient memory 35 reads out "1" as the interpolation coefficient K when the key touch is hardest and "0" when the key touch is softest. A predetermined interpolation coefficient K given by a condition $0<K<1$ so as to correspond to the degree of touch is read out in accordance with a predetermined interpolation function. The difference waveshape data is added to the waveshape (corresponding to the softest touch) read out from the memory 33 in accordance with an addition ratio corresponding to the degree of touch. As a result, the tone waveshape corresponding to the given touch is obtained.

Figure 5:
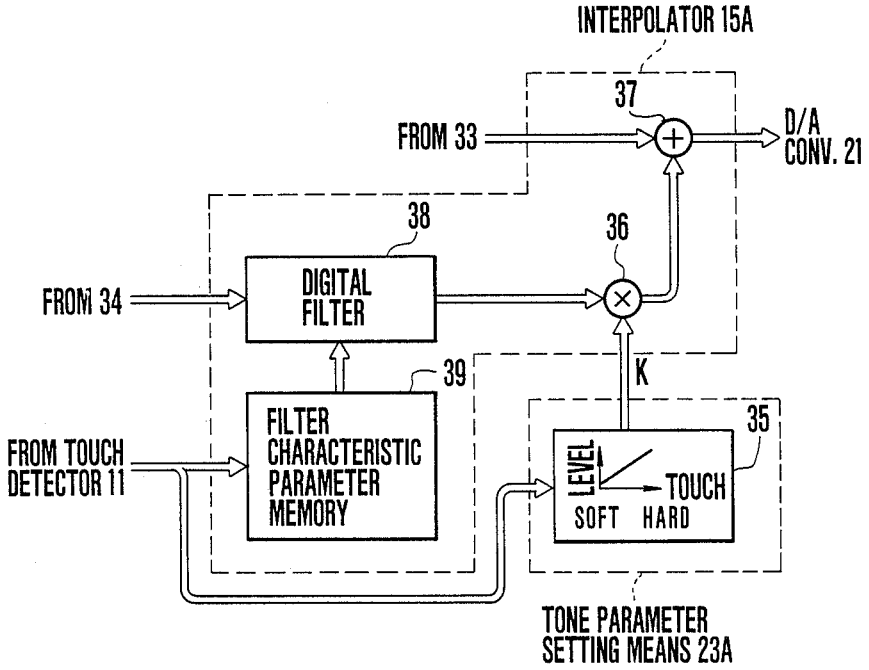
FIG. 5 is a block diagram showing a modification of an interpolator shown in FIG. 4.

The difference waveshape stored in the memory 34 is a difference between the waveshape corresponding to the hardest touch and the waveshape corresponding to the softest touch, so that the difference waveshape includes harmonic components and becomes rough. When it is added to the softest touch corresponding waveshape which is read out from the memory 33 even if this rough difference waveshape has a low level, the resultant waveshape may become different from the waveshape read out from the memory 33 and the waveshape obtained by the conventional musical instrument. In order to prevent this, the interpolator 15A is modified, as shown in FIG. 5. A digital filter (low-pass filter) 38 is connected to the output of the second waveshape memory 34. A filter characteristic parameter corresponding to the key touch is read out from a filter characteristic parameter memory 39 in accordance with the detected touch data. Therefore, the filter characteristics of the filter 38 can be controlled. This filter control is performed such that, when the key touch becomes softer, a smooth difference waveshape is generated from the filter 38, and when the key touch becomes harder, a rough difference waveshape is generated from the filter 38. When the key touch is the hardest touch, the waveshape from the waveshape memory 34 is not modified by the filter 38. In this manner, when the key touch is relatively soft, a smooth difference waveshape whose harmonic components having high frequency are detected from the rough difference waveshape is added to the softest touch waveshape (i.e., the output from the memory 33), thus eliminating the above drawback.

The hardest touch waveshape may be stored in the first waveshape memory 33, and the adder 37 may comprise a subtracter.

Figure 6:
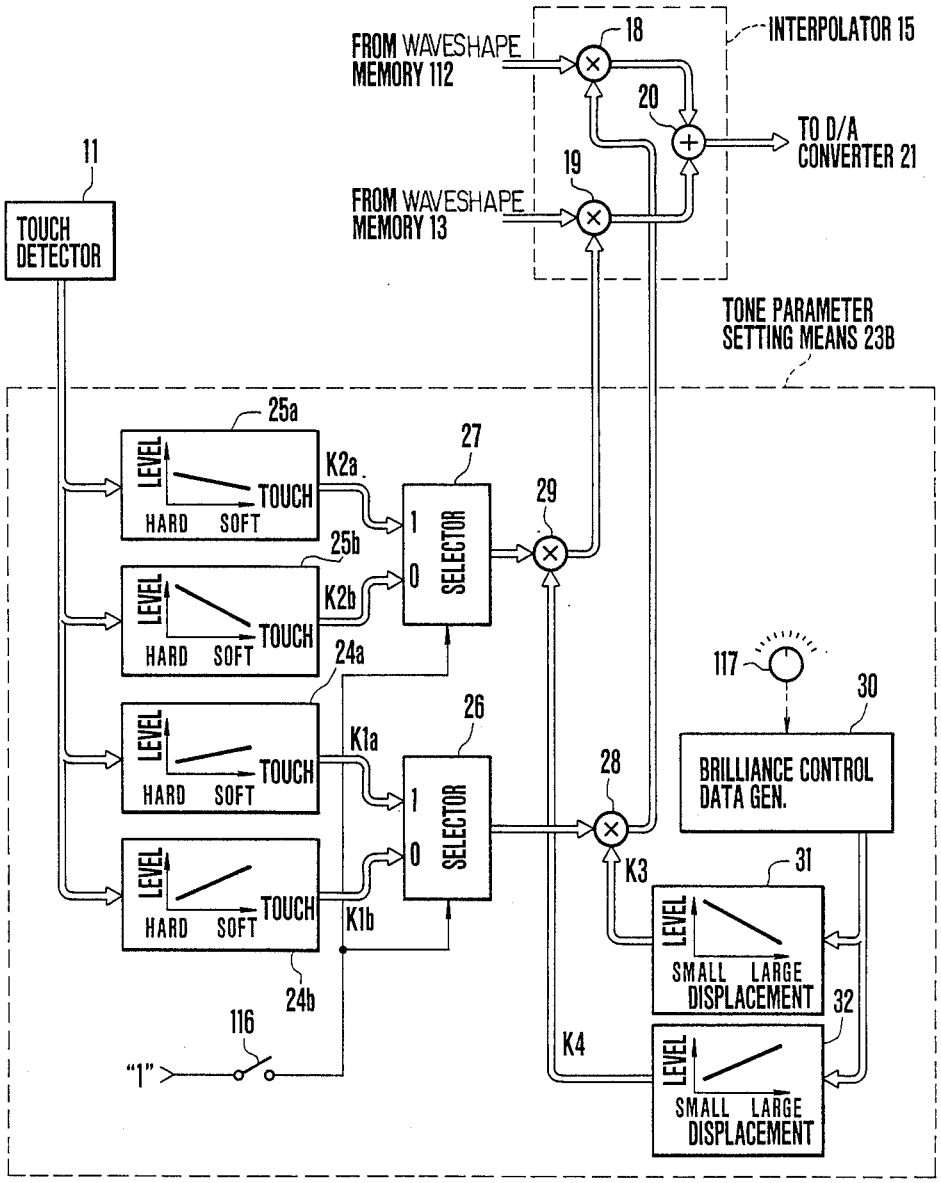
FIGS. 6 to 8 are respectively block diagrams showing other embodiments when tone color characteristics are specified by two parameters.

FIG. 6 shows a tone color parameter setting means 23B as the main feature of the present invention according to still another embodiment of the present invention. According to this embodiment, a soft pedal 116 and a brilliance control 117 for setting tone color parameters are used. The touch data as the output from the touch detector 11 is used as a first parameter for determining a tone color. Outputs from the soft pedal 116 and the brilliance control 117 are used as second parameters for determining the tone color.

In the tone color parameter setting means 23B, a pair of interpolation coefficient memories 24*a* and 25*a* store interpolation coefficients K1*a* and K2*a* which have relatively moderate curves of inverse characteristics with respect to the key touch, respectively. The interpolation coefficients K1*a* and K2*a* are read out from the interpolation coefficient memories 24*a* and 25*a* in response to the touch data. Another pair of interpolation coefficient memories 24*b* and 25*b* store interpolation coefficients K1*b* and K2*b* which have relative acute curves of inverse characteristics each other with respect to the key touch. The interpolation coefficients K1*b* and K2*b* are read out from the interpolation coefficient memories 24*b* and 25*b* in response to the touch data.

The interpolation coefficients K1*a* and K2*a* read out from the interpolation coefficient memories 24*a* and 25*a* are supplied to "1" input terminals of selectors 26 and 27, respectively. The interpolation coefficients K1*b* and K2*b* read out from the memories 24*b* and 25*b* are supplied to "0" input terminals of the selectors 26 and 27, respectively. A switch output signal from the soft pedal 116 is supplied to the selection control input terminals of the selectors 26 and 27. When the soft pedal 116 is depressed (i.e., when it is turned on), the switch output signal of logic "1" causes the selectors 26 and 27 to select the coefficients K1*a* and K2*a* supplied to the "1" input terminals. However, when the soft pedal 116 is not depressed (i.e., when it is turned off), the switch output signal of logic "0" causes the selectors 26 and 27 to select the coefficients K1*b* and K2*b* supplied to the "0" input terminals. Outputs from the selectors 26 and 27 are supplied to multipliers 18 and 19 in the interpolator 15 through multipliers 28 and 29, respectively. The coefficients from the selectors 26 and 27 are used as tone color parameters for setting a mixing ratio subject to the interpolation operation.

The interpolation coefficient K1*a* or K1*b* supplied to the multiplier 18 through the selector 26 has a larger value when the key touch becomes softer. The level of the waveshape signal corresponding to the softest touch read out from the first waveshape memory 12 is controlled by the multiplier 18 in accordance with the interpolation coefficient K1*a* or K1*b*. The interpolation coefficient K2*a* or K2*b* supplied to the multiplier 19 through the selector 27 has a larger value when the key touch becomes harder. The level of the waveshape signal corresponding to the softest touch read out from the second waveshape memory 13 is controlled by the multiplier 19 in accordance with the interpolation coefficients K2*a* or K2*b*. The tone waveshape signals from the multipliers 18 and 19 are obtained by interpolating the first waveshape corresponding to the softest touch and the second waveshape corresponding to the hardest touch and represent different tone colors (waveshapes) in accordance with different key touches.

The interpolation coefficients (i.e., tone parameters) supplied to the multipliers 18 and 19 in the interpolator 15 are determined by the key touch and the outputs from the soft pedal 116 and the brilliance control 117. When the soft pedal 116 is not depressed (i.e., when it is turned off), the interpolation coefficients K1*b* and K2*b* read out from the memories 24*b* and 25*b* are selected by the selectors 26 and 27 and are supplied to the multipliers 8 and 19 through the multipliers 28 and 29, respectively. However, when the soft pedal 116 is depressed (i.e., when it is turned on), the interpolation coefficients K1*a* and K2*a* read out from the memories 24*a* and 25*a* are selected by the selectors 26 and 27 and are supplied to the multipliers 18 and 19 through the multipliers 28 and 29, respectively. When interpolation is performed using the interpolation coefficients K1*b* and K2*b*, changes in interpolation coefficients with respect to changes in the degree of touch are relatively large, and so touch response control can be performed with relatively high sensitivity. On the other hand, when interpolation is performed using the interpolation coefficients K1*a* and K2*a*, changes in interpolation coefficients with respect to changes in degree of touch are relatively small, so that touch response control can be performed under a relatively surpressed condition. In this manner, the sensitivity control of the touch response can be performed in accordance with the ON/OFF operation of the soft pedal 116. As a result, a soft tone can be produced upon depression of the soft pedal. The degree of sensitivity control can be commonly applied to any musical tone.

On the other hand, brilliance control data is generated from a brilliance control data generator 30 in accordance with a state of the brilliance control 117. Brilliance control interpolation coefficients K3 and K4 are read out from interpolation coefficient memories 31 and 32 in response to the control data, respectively. The interpolation coefficient memories 31 and 32 store the interpolation coefficients K3 and K4 having inverse characteristics each other with respect to the brilliance control data. The interpolation coefficient K3 read out from the memory 31 is supplied to the multiplier 28 and is multiplied with the interpolation coefficient K1*a* or K1*b* from the selector 26. A product from the multiplier 28 is supplied to the multiplier 18. Similarly, the interpolation coefficient K4 read out from the memory 32 is supplied to the multiplier 29 and is multiplied with the interpolation coefficient K2*a* or K2*b* from the selector 27. The resultant product is supplied to the multiplier 19. Interpolation by using the interpolation coefficients K3 and K4 is performed such that the interpolation coefficients K3 and K4 are respectively decreased and increased when the brilliance control quantity set by the brilliance control 117 is increased. As a result, the ratio of the second waveshape becomes higher than that of the first waveshape to produce a musical tone having a large number of harmonic components. On the other hand, when the brilliance control quantity becomes smaller, the interpolation coefficients K3 and K4 are respectively increased and decreased, thereby increasing the ratio of the first waveshape to the second waveshape. As a result, a non-brilliant musical tone having a smaller number of harmonic components is produced. In this manner, the musical tone waveshape signals obtained through the interpolator 15 have different tone colors in accordance with the ON/OFF state of the brilliance control 117. The brilliance control can be commonly performed for any musical tone.

Figure 7:
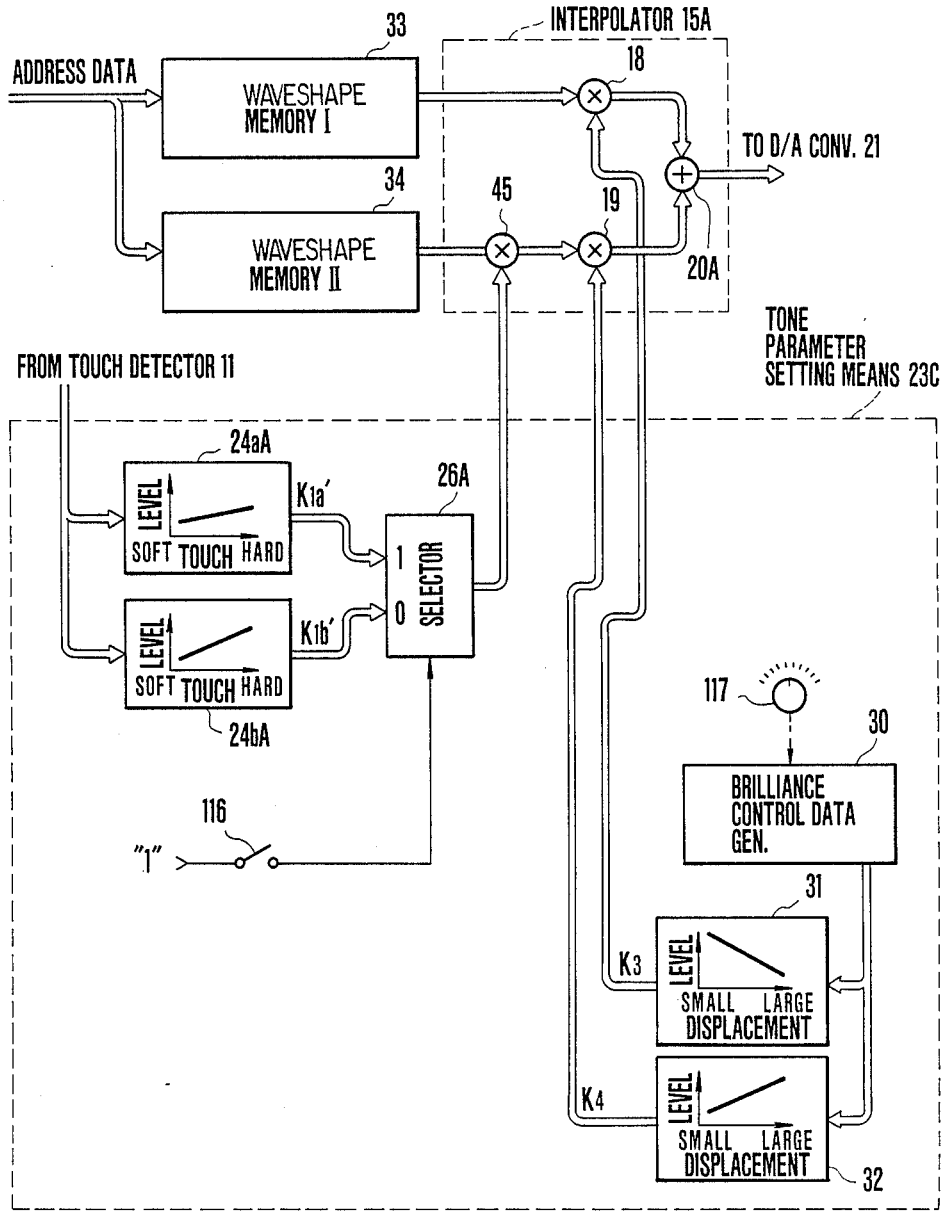

FIG. 7 shows still another embodiment which is substantially the same as that of FIG. 4, except that a soft pedal 116 and a brilliance control 117 are added. A first waveshape memory 33 stores a phase-corrected waveshape corresponding to the softest touch among the waveshapes processed by Processing 2a to Processing 2c or Processing 2'. In this embodiment, Processing 3 is added after Processing 1 and Processing 2 (2a to 2c or 2').

Processing 3

A difference between the phase-corrected waveshape and the other waveshape obtained by Processing 2 is calculated in units of sampling points, and a phase-corrected difference waveshape is obtained.

The difference waveshape obtained by Processing 3 is stored in a second waveshape memory 34. A tone color parameter setting means 23C has two memories 24*a*A and 24*b*A which are similar to the memories 24*a* and 24*b* as touch interpolation coefficient memories. One of the outputs from the memories 24*a*A and 24*b*A is selected by a selector 26A in accordance with the ON/OFF operation of the soft pedal 116. Outputs from the brilliance interpolation coefficient memories 31 and 32 are supplied to multipliers 18 and 19 in the interpolator 15A. In addition, a multiplier 45 is arranged between the second waveshape memory 34 and the multiplier 19. The interpolation coefficient K1*a*' or K1*b*' selected by the selector 26A is supplied to the multiplier 45.

In the interpolator 15A, the interpolation coefficient K1*a*' or K1*b*' read out from the memory 24*a*A or 24*b*A is multiplied by the multiplier 45 with the difference waveshape data read out from the second waveshape memory 34. A multiplied result is added by an adder 20A to the output (corresponding to the softest touch waveshape) read out from the first waveshape memory 33. The interpolation coefficient memory 24*b*A generates the coefficient K1*b*' of "1" when the key touch is the hardest and the coefficient K1*b*' of "0" when the key touch is the softest. In this manner, a coefficient K1*b*' given under a condition K1*b*' $<1$ is generated in accordance with a given degree of touch. The interpolation coefficient K1*a*' of "0" is read out from the interpolation coefficient memory 24*a*A when the key touch is the softest. Otherwise, the interpolation coefficient K1*a*' having a more moderate slope than that of the function of the interpolation coefficient K1*b*' is read out. The adding ratio of the difference waveshape data to the waveshape read out from the memory 33 and corresponding to the softest touch is controlled in accordance with the key touch strength (i.e., the sensitivity corresponding to the operating state of the soft pedal 116). Therefore, a musical tone waveshape signal having a tone color characteristic corresponding to the touch strength is synthesized. Brilliance control in accordance with the ON/OFF operation of the brilliance control 117 is performed such that the interpolation coefficients K3 and K4 are multiplied with the outputs from the waveshape memories 33 and 34, respectively.

Figure 8:
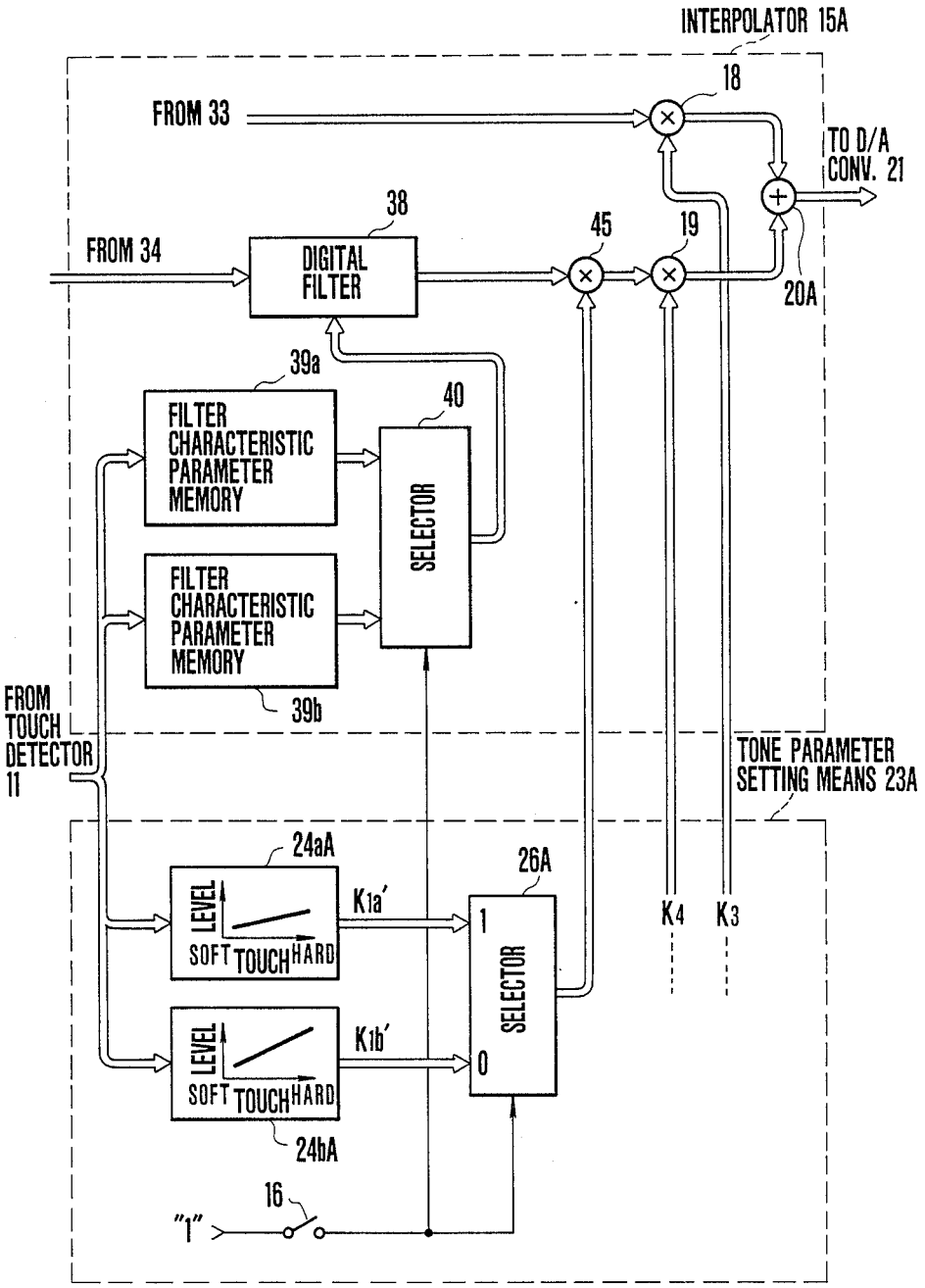

FIG. 8 shows a modification of the arrangement shown in FIG. 7 so as to increase the number of harmonic components included in the difference waveshape stored in the memory 34. The technique described with reference to FIG. 5 is assembled in the arrangement of FIG. 7. Referring to FIG. 8, the interpolator 15A has a digital filter (low-pass filter) 38 connected to the output terminal of the second waveshape memory 34. Filter characteristic parameters corresponding to the key touch are read out from filter characteristic parameter memories 39*a* and 39*b* in response to the detected touch data. One of the readout data is selected by a selector 40 in response to an output from the soft pedal 116 so as to determine the filter characteristics of the filter 38. When the soft pedal 116 is turned off (i.e., is not depressed), a soft difference waveshape is generated from the filter 38 when the key touch is softer. However, when the key touch becomes harder, a difference waveshape having a large number of harmonic components is generated from the filter 38. When the key touch becomes the hardest, the waveshape from the waveshape memory 38 passes through the filter 38 without any modification. On the other hand, when the soft pedal 116 is depressed, the filter characteristic modification upon changes in key touch becomes more apparent than in the csse wherein the soft pedal 116 is kept off. Therefore, when the key touch is relatively soft, the difference waveshape added to the softest touch waveshape (the output from the memory 33) becomes smooth and has a small number of harmonic components, thereby solving the problem described above.

In the same manner as in FIG. 5, the hardest touch waveshape may be stored in the first waveshape memory 33, and the adder 20A may be a subtracter.

In the respective embodiments described above, the complete waveshapes from the beginning to the end of the tone are stored in the waveshape memories 12, 13, 33 and 34. However, the fundamental portion or leading portion of the waveshape and part of the subsequent portion may be stored in a memory. In this case, the address data generator 14 accesses the leading portion of the waveshape and then repeatedly accesses the part of the subsequent portion (of a number of periods) so as to generate the complete waveshape from the beginning to the end of the tone. An amplitude envelope of the repeatedly readout waveshape signal is given by a proper envelope generating means.

The waveshape having a plurality of periods and stored in the waveshape memory need not be a continuous waveshape but may be a discrete waveshape having a plurality of periods. For example, the actual musical tone waveshape may be divided into a plurality of frames. Typical one- or two-period waveshape portions are then selected in units of frames and are stored. The stored waveshape data are sequentially switched and can be repeatedly read out. As needed, the previous waveshape and the next waveshape may be interpolated to obtain a smooth musical tone waveshape. Furthermore, as shown in Japanese Patent Disclosure No. 58-142396, the musical tone waveshape data of a plurality of periods is stored and is repeatedly read out to decrease the waveshape memory capacity.

Furthermore, the waveshape from the beginning to a portion subjected to decay may be stored with an amplitude envelope in a waveshape memory. Part of the subsequent waveshape data with a given amplitude level may be stored in another waveshape memory. In this case, the waveshape from the beginning to the decay portion is read out once. Thereafter, the waveshape data with the given amplitude level is repeatedly read out. The repeatedly readout signal is assigned with a decay envelope by a proper envelope generating means. With this arrangement, an S/N ratio of the waveshape data during the decay period can be improved.

The musical tone waveshape amplitude sampled data need not be stored in the waveshape memories 12, 13 and 33 without modification (i.e., in accordance with the PCM system). The difference data between the sampled amplitude values may be stored. When the difference data are read out, they are accumulatively added or subtracted to obtain original amplitude sampled data (i.e., in accordance with the differential PCM system). Furthermore, a proper waveshape coding system such as a delta modulation (DM) system or an adaptive delta modulation (ADM) system may be used to store the coded waveshape data.

The tone color parameters need not be data associated with the key touch but may include any type of data. For example, in order to change the tone color in accordance with a pitch of the tone to be produced (i.e., in order to perform key scaling control of the tone color), the touch data may be replaced with pitch data or tone range data to obtain the same effect as in any one of the embodiments described above.

Figure 9:
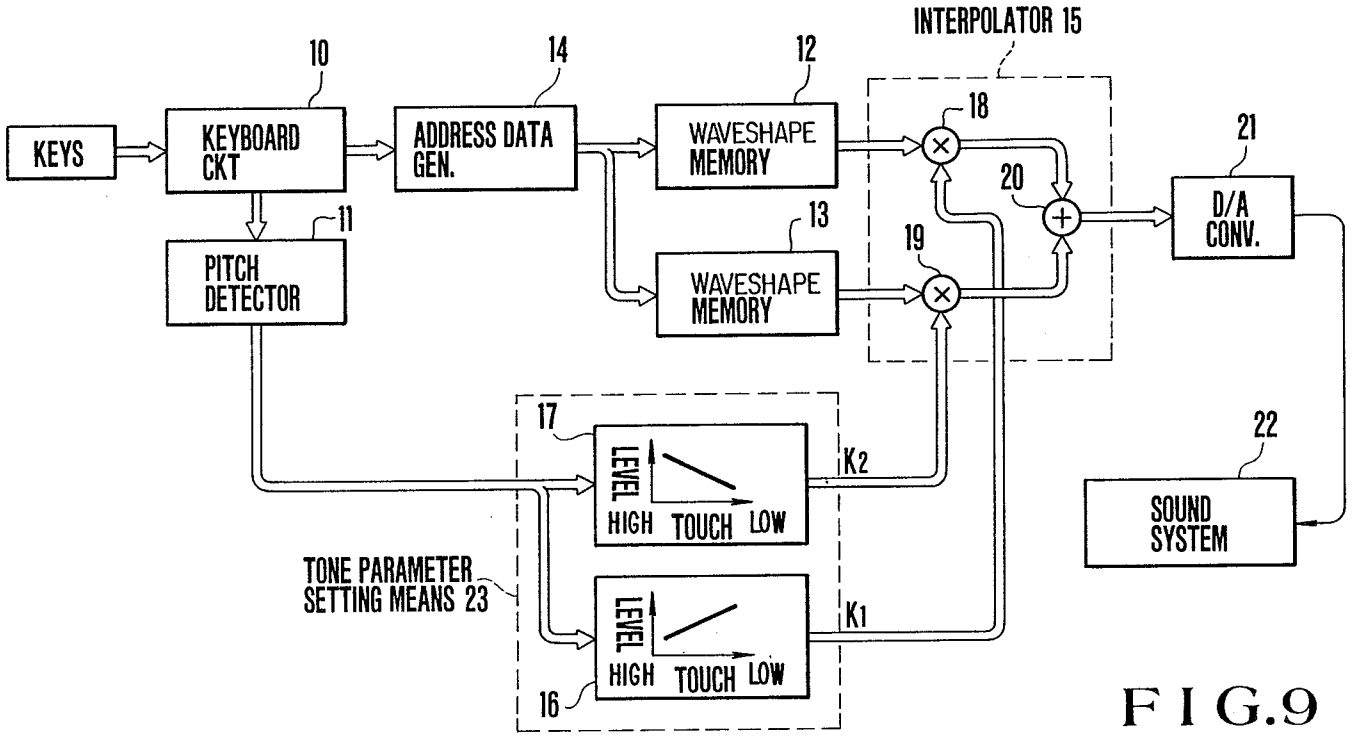
FIG. 9 is a block diagram showing still another embodiment when tone color characteristics are specified by pitch data.

FIG. 9 shows still another embodiment for performing key scaling control by detecting a pitch of a depressed key. The arrangement in FIG. 9 substantially corresponds to that of FIG. 1. Referring to FIG. 9, a pitch detector 11P supplies pitch data of a depressed key to a tone color parameter setting means 23P. Interpolation coefficient memories 16 and 17 in the tone color parameter setting means 23P store interpolation coefficients K1 and K2 corresponding to pitch levels, respectively. Therefore, every time the detected pitch data are supplied to the memories 16 and 17, the corresponding interpolation coefficients K1 and K2 are read out from the memories 16 and 17, respectively. All other arrangements of FIG. 9 are substantially the same as that of FIG. 1, and a detailed description thereof will be omitted.

According to the present invention as described above, the two types of waveshape signals obtained on the basis of the readout data from the two waveshape memories are interpolated in accordance with the tone color parameters to obtain a musical tone signal having a desired tone color. Even if only two high-quality waveshapes are stored in the respective waveshape memories, high-quality waveshapes can be obtained in accordance with various types of parameters (i.e., the key touch, the pitch of the depressed key, the ON/OFF state of the soft pedal or the brilliance control). Therefore, high-quality tone changes can be relatively easily performed at low cost. In addition, the tone color parameters used for interpolation/synthesis comprise a first parameter for independently controlling different tone colors of the respective musical tones to be produced, and a second parameter for commonly controlling the tone color of the respective musical tones to be produced. Possible tone color control can thus be performed.

The present invention is not limited to the above embodiments. Various changes and modifications may be made within the spirit and scope of the invention.

Assume a musical tone waveshape shown in FIG. 10A. This waveshape is divided into at least two blocks (4 blocks a to d in the example in FIG. 10). Only parts of the respective blocks are stored in waveshape memories 12 and 13, as shown in FIG. 10B. The waveshape data stored in the waveshape memories 12 and 13 differ from each other as in the earlier embodiments. For example, the waveshape data stored in the waveshape memory 12 corresponds to the hardest key touch, while the waveshape data stored in the waveshape memory 13 corresponds to the softest key touch.

One of the waveshape read operations in the above case is performed such that each waveshape part stored in the memories is repeatedly read out until the reading timing of the next waveshape part to produce a continuous musical tone waveshape. Another read operation is performed such that a portion between the partial waveshape data read out from the waveshape memories is interpolated by a known method. The latter method is implemented by a circuit shown in FIG. 11. Referring to FIG. 11, the partial waveshapes read out from the waveshape memories 12 and 13 are supplied to interpolators 51 and 52. An interpolated value of the two adjacent partial waveshapes is obtained to produce an interpolated waveshape. A continuous full waveshape is then produced by using the interpolated waveshape. The resultant continuous waveshape is supplied to an interpolator 15.

What is claimed is:

1. An electronic musical instrument comprising:

pitch designating means for designating a pitch of a musical tone to be produced;

first waveshape generating means for generating a first waveshape based on first waveshape data;

second waveshape generating means for generating a second waveshape based on second waveshape data;

detecting means for detecting an amount of depression of a depressed key;

mixing information generating means for generating mixing information representing a mixing ratio of said first waveshape data to said second waveshape data in accordance with said detected amount of depression; and interpolating means connected to said first and second waveshape generating means and said mixing means for mixing said first and second waveshape data at said mixing ratio and forming a musical tone waveshape for said musical tone to be produced;

said first waveshape generating means comprising a first memory which stores said first waveshape data representing a first certain waveshape which has plural periods and whose shape varies with time and first readout means which reads out said first waveshape data at a rate corresponding to the designated pitch; and said second waveshape generating means comprising a second memory which stores said second waveshape data and second readout means which reads out said second waveshape dfata at a rate corresponding to said designated pitch.

2. An electronic musical instrument according to claim 1, wherein said first musical tone waveshape has a phase angle and said second musical tone waveshape has a phase angle, and the phase angle of said first musical tone waveshape changes at substantially the same rate as does the phase angle of said second musical tone waveshape.

3. An electronic musical instrument according to claim 2, wherein said second waveshape is formed by filtering in advance said first waveshape through a filter, said filter having an amplitude and frequency range corresponding to the difference between the amplitude and frequency of said first and second waveshapes, said filter further haviing a substantially linear response.

4. An electronic musical instrument according to claim 3, wherein said first and second waveshapes are respectively divided into first to Kth frames, K being an integer greater than or equal to 2 and wherein said amplitude and frequency range of said filter correspondingly varies with the difference in amplitude and frequency between parts of said first frames among said first and second waveshapes to parts of said Kth frames among said first and second musical tone waveshapes.

5. An electronic musical instrument according to claim 1, wherein said pitch designating means comprises keyboard means having a plurality of keys corresponding to different pitches respectively.

6. An electronic musical instrument according to claim 1, wherein said first musical tone waveshape is a musical tone waveshape produced by a musical instrument under a first condition, and said second musical tone waveshape is a musical tone waveshape produced by said musical instrument under a second condition.

7. An electronic musical instrument according to claim 6, wherein said detectings means comprises key depression force detecting means for detecting a key depression force of a depressed key and wherein said mixing information generating means connected to said key depression force detecting means determines said mixing ratio in accordance with said detected key depression force, said first condition being a minimum key depression force, and said second condition being a maximum key depression force.

8. An electronic musical instrument according to claim 6, wherein said detecting means comprises key depression speed detecting means for detecting a key depression speed of a depressed key and wherein said mixing information generating means connected to said key depression speed detecting means determines said mixing ratio in accordance with said detected key depression speed, said first condition being the minimum key depression speed, and said second condition being the maximum key depression speed.

9. An electronic musical instrument according to claim 6, wherein said pitch designating means further comprises keyboard means having a plurality of keys corresponding to different pitches respectively and wherein said mixing information generating means determines said mixing ratio in accordance with the pitch designated by said pitch designating means, and said first condition being a key depression corresponding to the maximum pitch and said second condition being a key depression corresponding to the minimum pitch.

10. An electronic musical instrument according to claim 1, further comprising modifying amount setting means for setting a modifying amount of said mixing ratio, and modifying means connected to said mixing information generating means, for modifying said mixing ratio in accordance with said modifying amount set by said modifying amount setting means.

11. An electronic musical instrument according to claim 7, wherein said mixing ratio comprises a plurality of different ratios for an identical key depression force and which further comprises a manually operated soft pedal and selecting means for selecting one among said plurality of different ratios in accordance with an operation state of said manually operated soft pedal so that said interpolating means mixes said first and second waveshape data at the ratio selected by said selecting means.

12. An electronic musical instrument according to claim 8, wherein said mixing ratio comprises a plurality of different ratios for an identical key depression speed and which further comprises a manually operated soft pedal and selecting means for selecting one among said plurality of different ratios in accordance with an operation state of said manually operated soft pedal so that said interpolating means mixes said first and second waveshape data at the ratio selected by said selecting means.

13. An electronic musical instrument according to claim 1, wherein said second waveshape data represents a second certain waveshape which has plural periods and whose shape varies with time, said first readout means for reading out said first waveshape data sequentially, and said second readout means for reading out said second waveshape data sequentially.

14. An electronic musical instrument according to claim 1, wherein a first portion of said first waveshape data corresponds to an attack period of said first certain waveshape and wherein a second portion of said frist waveshape data corresponds to a subsequent period of said first certain waveshape following said attack period said first readout means firstly reading out said first portion and repeatedly reading out said second portion.

15. An electronic musical instrument according to claim 14, wherein said first waveshape data represents said first portion of said first certain waveshape as said first certain waveshape varies with time.

16. An electronic musical instrument according to claim 15, wherein said first readout means reads out said first waveshape data sequentially, at a predetermined interval, said interval corresponding to each period of said plural periods of said first certain waveshape.

17. An electronic musical instrument according to claim 15, wherein said first readout means sequentially reads out said first waveshape data and wherein said first waveshape generating means comprises interpolating means for interpolating a third waveshape data representing a third certain waveshape which has plural periods and whose shape varies with time and for producing a waveshape between each period of said plural periods of said third certain waveshape.

18. The electronic musical instrument of claim 1, wherein said first waveshape comprises the attack portion of said first certain waveshape.

19. An electronic musical instrument according to claim 1, wherein said first waveshape data comprises first to Nth block waveshape data corresponding to first Nth block waveshapes which are divided into first to Nth blocks, said first to Nth blocks comprising the number of blocks into which a first musical tone waveshape is divided, wherein N is an integer greater than or equal to 2 and wherein said first readout means reads out said first to Nth block waveshape data at said rate corresponding to said designated pitch.

20. An electronic musical instrument according to claim 19, wherin a first to Nth block waveshape data represents parts of said first to Nth block waveshapes respectively.

21. An electronic musical instrument according to claim 19, wherein said first readout means reads out said first to Nth block waveshape data sequentially, each of said first to Nth block waveshape data being read out repetitively by a lapse of time corresponding to each of said first to Nth blocks.

22. An electronic musical instrument according to claim 19, wherein said first readout means sequentially reads out said first to Nth block waveshape data and said first waveshape generating means comprises interpolating means for interpolating Lth and (L+1)th block waveshape data and producing a new waveshape during a portion between the parts of said Lth and (L+1)th block waveshapes, L being an integer greater than or equal to 1 and less than N−1.

23. An electronic musical instrument comprising:

pitch designating means for designating a pitch of a musical tone to be produced;

first means for generating a first waveshape based on first waveshape data;

second means for generating a difference waveshape representing a difference between said first waveshape and a second waveshape, either one of said first waveshape and said second waveshape having plural periods and varying with time in its shape and said first waveshape and said second waveshape being different from each other;

detecting means for detecting an amount of depression of a depressed key;

level designating means for designating an amplitude level of said second waveshape data in accordance with said detected amount of depression; and interpolating means coupled to said first means, second means and level designating means for adding said first waveshape data to said second waveshape data whose amplitude level is designated by said level designating means.

24. The electronic musical instrument of claim 23, wherein said first waveshape comprises the attack portion of said first certain waveshape.

25. An electronic musical instrument comprising:

pitch designating means for designating a pitch of a musical tone to be produced;

first waveshape generating means for generating a first waveshape based on first waveshape data;

second waveshape generating means for generating a second waveshape based on second waveshape data;

detecting means for detecting a value corresponding to a depressed key;

mixing information generating means for generating mixing information representing a mixing ratio of said first waveshape data to said second waveshape data in accordance with said value; and interpolating means connected to said first and second waveshape generating means and said mixing means for mixing said first and second waveshape data at said mixing ratio and forming a musical tone waveshape for said musical tone to be produced;

said first waveshape generating means comprising a first memory which stores said first waveshape data representing a certain waveshape which has plural periods and whose shape varies with time and first readout means which reads out said first waveshape data at a rate corresponding to the designated pitch; and said second waveshape generating means comprising a second memory which stores said second waveshape data and second readout means which reads out said second waveshape data at a rate corresponding to said designated pitch.

26. The electronic musical instrument of claim 25, wherein said first waveshape comprises the attack portion of said first certain waveshape.

27. An electronic musical instrument according to claim 25, wherein said first waveshape data comprises first to Nth block waveshape data corresponding to first to Nth block waveshapes which are divided into first to Nth blocks, said first to Nth blocks comprising the number of blocks into which a first musical tone waveshape is divided, wherein N is an integer greater than or equal to 2 and wherein said first readout means reads out said first to Nth block waveshape data at said rate corresponding to said designated pitch.

28. An electronic musical instrument according to claim 27, wherein a first to Nth block waveshape data represents parts of said first to Nth block waveshapes respectively.

29. An electronic musical instrument according to claim 27, wherein said first readout means reads out said first to Nth block waveshape data sequentially, each of said first to Nth block waveshape data being read out repetitively by a lapse of time corresponding to each of said first to Nth blocks.

30. An electronic musical instrument according to claim 27, wherein said first readout means sequentially reads out said first to Nth block waveshape data and said first waveshape generating means comprises interpolating means for interpolating Lth and (L+1)th block waveshape data and producing a new waveshape during a portion between the parts of said Lth and (L+1)th block waveshapes, L being an integer greater than or equal to 1, and less than N−1.

31. An electronic musical instrument according to claim 25 wherein said value corresponds to a pitch of said depressed key.

32. An electronic musical instrument according to claim 25 wherein said value corresponds to an amount of depression of said depressed key.

33. An electronic musical instrument comprising:

pitch designating means for designating a pitch of a musical tone to be produced;

first waveshape generating means for generating a first waveshape based on first waveshape data;

second waveshape generating means for generating a second waveshape based on second waveshape data;

operating member means having at least one operating member capable of being manually operated;

detecting means for detecting a degree of operation of said operating means;

mixing information generating means for generating mixing information representing a mixing ratio of said first waveshape data to said second waveshape data in accordance with said detected degree of operation;

interpolating means connected to said first and second waveshape generating means and said mixing means for mixing said first and second waveshape data at said mixing ratio and forming a musical tone waveshape for said musical tone to be produced;

said first waveshape generating means comprising a first memory which stores said first waveshape data representing a certain waveshape which has plural periods and whose shape varies with time and first readout means which reads out said first waveshape data at a rate corresponding to said designated pitch and;

said second waveshape generating means comprising a second memory which stores said second waveshape data and second readout means which reads out said second waveshape data at a rate corresponding to said designated pitch.

34. An electronic musical instrument according to claim 33 wherein said operating means comprises a keyboard having a plurality of keys, wherein each one of said keys constitutes a different operating member such that said designation of a pitch by said pitch designating means is determined by actuation of one of said plurality of keys.

35. An electronic musical instrument according to claim 33 wherein said operating member modifies a tone color of said musical tone to be produced.

36. An electronic musical instrument according to claim 35 wherein said operating member modifies said tone color by varying a brilliance amount, said brilliance amount being imparted on said musical tone to be produced.

37. The electronic musical instrument of claim 33, wherein said first waveshape comprises the attack portion of said first certain waveshape.

38. An electronic musical instrument according to claim 33, wherein said first waveshape data comprises first to Nth block waveshape data corresponding to first to Nth block waveshapes which are divided into first to Nth blocks, said first to Nth blocks comprising the number of blocks into which a first musical tone waveshape is divided, wherein N is an integer greater than or equal to 2 and wherein said first readout means reads out said first to Nth block waveshape data at said rate corresponding to said designated pitch.

39. An electronic musical instrument according to claim 38, wherein a first to Nth block waveshape data represents parts of said first to Nth block waveshapes respectively.

40. An electronic musical instrument according to claim 38, wherein said first readout means reads out said first to Nth block waveshape data sequentially, each of said first to Nth block waveshape data being read out repetitively by a lapse of time corresponding to each of said first to Nth blocks.

41. An electronic musical instrument according to claim 38, wherein said first readout means sequentially reads out said first to Nth block waveshape data and said first waveshape generating means comprises interpolating means for interpolating Lth and (L+1)th block waveshape data and producing a new waveshape during a portion between the parts of said Lth and (L+1)th block waveshapes, L being an integer greater than or equal to 1 and less and N−1.

42. An electronic musical instrument comprising:

pitch designating means for designating a pitch of a musical tone to be produced;

first waveshape generating means for generating a first waveshape based on first waveshape data;

second waveshape generating means for generating a second waveshape based on second waveshape data;

mixing information generating means for generating mixing information representing a mixing ratio of said first waveshape data to said second waveshape data;

interpolating means connected to said first and second waveshape generating means and said mixing means for mixing said first and second waveshape data at said mixing ratio and forming a musical tone waveshape for said musical tone to be produced;

said first waveshape generating means comprising a first memory which stores said first waveshape data representing a first certain waveshape which has an attack portion and plural periods and whose shape varies with time and first readout means which reads out said first waveshape data at a rate corresponding to the designated pitch; and said second waveshape generating means comprising a second memory which stores said second waveshape data and second readout means which reads out said second waveshape data at a rate corresponding to said designated pitch.

43. The electronic musical instrument of claim 42, wherein said first waveshape comprises the attack portion of said first certain waveshape.

44. The electronic musical instrument of claim 42, wherein said first waveshape comprises the attack portion of said first certain waveshape.

45. An electronic musical instrument according to claim 42, wherein said first waveshape data comprises first to Nth block waveshape data corresponding to first to Nth block waveshapes which are divided into first to Nth blocks, said first to Nth blocks comprising the number of blocks into which a first musical tone waveshape is divided, wherein N is an integer greater than or equal to 2 and wherein said first readout means reads out said first to Nth block waveshape data at said rate corresponding to said designated pitch.

46. An electronic musical instrument according to claim 45, wherein a first to Nth block waveshape data represents parts of said first to Nth block waveshapes respectively.

47. An electronic musical instrument according to claim 45, wherein said first readout means reads out said first to Nth block waveshape data sequentially, each of said first to Nth block waveshape data being read out repetitively by a lapse of time corresponding to each of said first to Nth blocks.

48. An electronic musical instrument according to claim 45, wherein said first readout means sequentially reads out said first to Nth block waveshape data and said first waveshape generating means comprises interpolating means for interpolating Lth and (L+1)th block waveshape data and producing a new waveshape during a portion between the parts of said Lth and (L+1)th block waveshapes, L being an integer greater than or equal to 1 and less than N−1.

* * * * *

UNITED STATES PATENT AND TRADEMARK OFFICE

CERTIFICATE OF CORRECTION

PATENT NO. : 4,779,505

DATED : 10-25-88

INVENTOR(S) : Suzuki

It is certified that error appears in the above-identified patent and that said Letters Patent is hereby corrected as shown below:

| Column | Line | Correction |
|---|---|---|
| 1 | 31 | delete "complete", insert --complete waveshape from the beginning to the end of musical tone-- |
| 10 | 7 | delete "Klb'<1", insert --0<Klb'<1-- |
| 10 | 51 | delete "csse", insert --case-- |
| 12 | 26 | delete "a to d", insert --a to d-- |
| 13 | 31 | delete "haviing", insert --having-- |
| 14 | 50 | delete "frist", insert --first-- |

Signed and Sealed this

Fourth Day of July, 1989

*Attest:*

DONALD J. QUIGG

*Attesting Officer*

*Commissioner of Patents and Trademarks*